US005608980A

United States Patent [19]

Pangerl

[11] Patent Number: 5,608,980

[45] Date of Patent: Mar. 11, 1997

[54] TAMPER-RESISTANT DISPLAY HOLDER

[75] Inventor: Gary D. Pangerl, Braham, Minn.

[73] Assignee: Clearr Corp., Minnetonka, Minn.

[21] Appl. No.: 546,946

[22] Filed: Oct. 23, 1995

[51] Int. Cl.[6] ..... G09F 1/12

[52] U.S. Cl. ..... 40/793; 292/251.5

[58] Field of Search ..... 40/792, 793, 794, 40/796; 292/251.5

[56] References Cited

U.S. PATENT DOCUMENTS

| | | | |
|---|---|---|---|
| 2,882,633 | 4/1959 | Howell | 40/793 |
| 3,310,901 | 3/1967 | Sarkisian . | |
| 3,386,198 | 6/1968 | Howell | 40/793 |
| 4,145,828 | 3/1979 | Hillstrom . | |
| 4,263,732 | 4/1981 | Gutierrez et al. . | |
| 4,420,138 | 12/1983 | Sobel . | |
| 4,498,255 | 2/1985 | Heard | 40/793 |
| 4,519,152 | 5/1985 | Seely et al. . | |
| 4,580,361 | 4/1986 | Hillstrom et al. | 40/603 |
| 4,702,025 | 10/1987 | Mace | 40/793 |
| 4,756,107 | 7/1988 | Hillstrom | 40/603 |
| 4,763,428 | 8/1988 | Fischer . | |
| 4,782,610 | 11/1988 | Hillstrom et al. . | |
| 4,937,959 | 7/1990 | Palmer et al. . | |
| 4,958,458 | 9/1990 | Hillstrom et al. . | |
| 5,040,586 | 8/1991 | Hillstrom . | |
| 5,188,405 | 2/1993 | Maccaferri | 292/251.5 X |
| 5,265,362 | 11/1993 | Yamaguchi | 40/711 X |
| 5,307,575 | 5/1994 | Ivansson et al. | 40/793 |
| 5,353,536 | 10/1994 | Erber et al. | 40/611 |
| 5,355,603 | 10/1994 | Luikkonen | 40/541 |
| 5,485,733 | 1/1996 | Hoffmann | 292/251.5 X |

OTHER PUBLICATIONS

Marketing Catalog, MDI Marketing Displays International, published at least as early as Oct. 23, 1995.

*Primary Examiner*—Joanne Silbermann

*Attorney, Agent, or Firm*—Westman, Champlin & Kelly, P.A.

[57] ABSTRACT

A tamper-resistant display holder is responsive to the selective application of an external magnetic field. The display holder includes at least one frame section having an elongated front member and an elongated back member which are adapted to be interconnected to one another in a pivotal relationship for holding a display piece. The display holder further includes a magnetically attractable locking tab having first and second opposite ends. The first end is pivotally attached to the front member such that the second end is movable between a locked position and an unlocked position relative to the back member in response to the external magnetic field.

22 Claims, 4 Drawing Sheets

10
14
16
12
20
22
18
7
2

TAMPER-RESISTANT DISPLAY HOLDER

BACKGROUND OF THE INVENTION

The present invention relates to a tamper-resistant display holder having a magnetically attractable tab which locks and unlocks a front member of the holder relative to a back member of the holder.

Display holders and frames are used for replaceable posters, pictures and similar advertising materials. Display holders are used in various public and private areas such as buses, taxicabs, store fronts, floor stands and other advertising locations. Display holders are preferably constructed such that the advertising materials can be easily replaced but not tampered with or stolen, particularly when the display holder is used in a public area.

An example of a tamper-proof display holder of the prior art is a locked box, such as that disclosed in U.S. Pat. No. 4,763,428, which has a window through which the advertising materials can be viewed. The locked box requires a key to be opened. The locked boxes of the prior art are typically expensive, cumbersome and unattractive.

A variety of more streamlined and economical spring-loaded display holders have been developed in which the advertising materials are interchangeable by hand. For example, U.S. Pat. No. 3,310,901 discloses a display holder having a plurality of frame sections. Each section includes two extruded portions which are interconnected with one another in a pivotal relationship. A metal leaf spring biases the extruded portions together to releasably clamp posters or similar display items in the frame. One of the extruded portions includes a lip that can be grasped to open or close the frame section. The display holder can therefore be readily tampered with.

U.S. Pat. No. 4,519,152 discloses a display holder having frame sections with smooth surfaces and rounded, non-convoluted corners such that the frame sections cannot be easily gripped with enough frictional force to open the frame. An opener tool with a lever arm is disclosed for engaging the front portion of the frame to open the display holder. The disclosed display holder is not entirely tamper proof, however, since the frame can be pried open with any handy tool, such as a pen or a knife.

SUMMARY OF THE INVENTION

The tamper-resistant display holder of the present invention is responsive to the selective application of an external magnetic field. The display holder includes at least one frame section having an elongated front member and an elongated back member which are adapted to be interconnected to one another in a pivotal relationship for holding a display piece. The display holder further includes a magnetically attractable locking tab having first and second opposite ends. The first end is pivotally attached to the front member such that the second end is movable between a locked position and an unlocked position relative to the back member in response to the external magnetic field.

In one preferred embodiment, the front and back members have first and second grooves, respectively, which generally oppose one another. The first end of the tab is attached to the front member within the first groove. In the locked position, the second end of the tab rests in the second groove, which prevents movement of the tab and the front member relative to the back member. In the unlocked position, the second end of the tab is disengaged from the back member and second groove, which allows movement of the front member relative to the back member.

In the preferred embodiment, the first groove has a cross section that mates with the cross section of the first end of the tab. The first groove has an angled inner surface that faces generally away from the back member. The first end of the tab has a beveled surface that mates with the angled surface of the first groove and generally faces the back member. The beveled surface of the tab is bonded to the angled inner surface of the first groove by a resilient adhesive such that the second end of the tab is biased into the second groove in the absence of the external magnetic field.

When the external magnetic field is applied to the tab, the second end of the tab lifts out of the second groove, thereby disengaging the tab from the back member and allowing the front member to move freely relative to the back member.

In operation, the user can insert or remove the display piece by simply sliding a magnet along the frame until an attraction is felt between the magnet and the tab. The tab therefore provides a locking mechanism that is easy to use and is effective in preventing tampering.

DETAILED DESCRIPTION OF THE PREFERRED EMBODIMENTS

Figure 1:
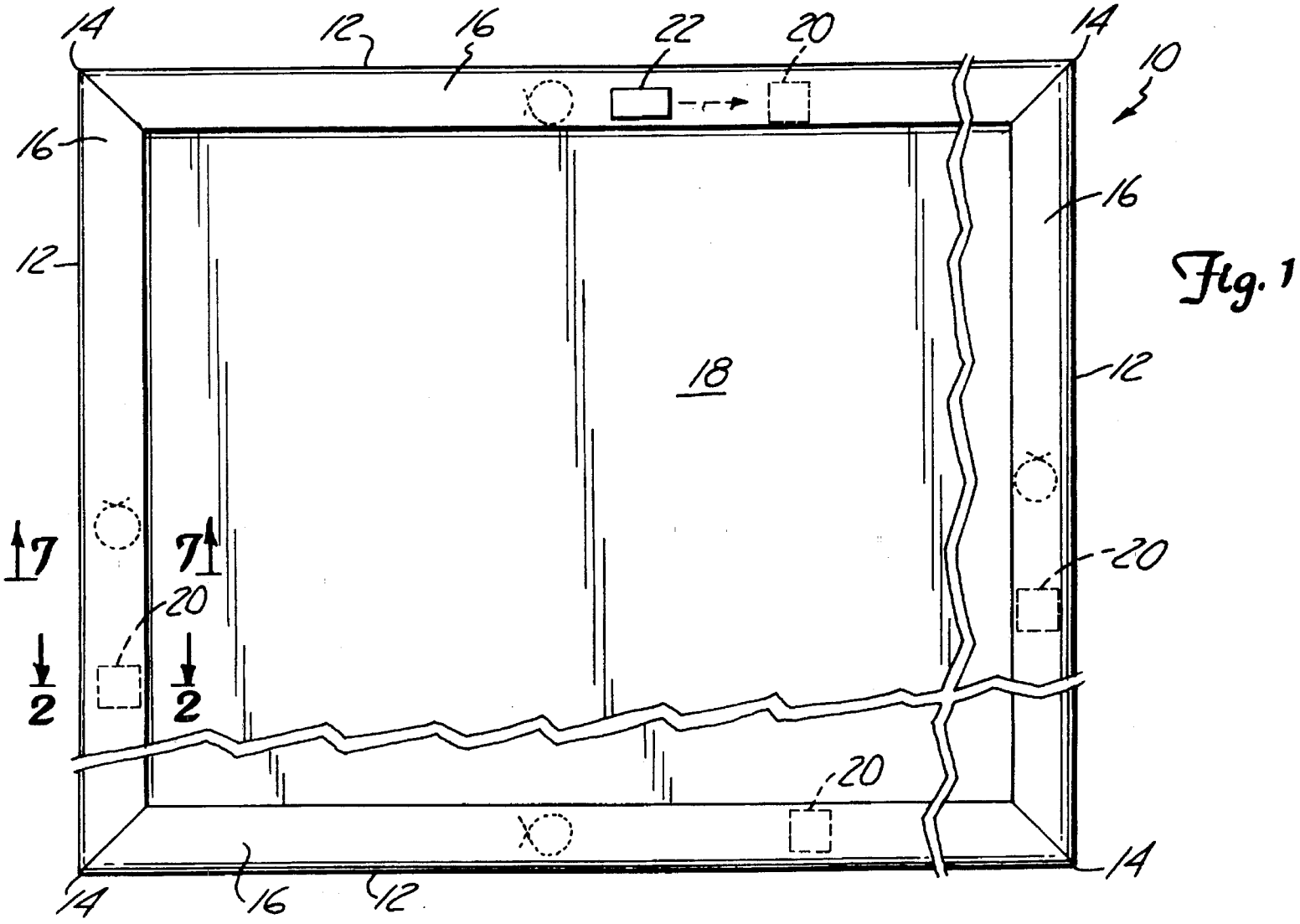
FIG. 1 is a plan view of a tamper-resistant display holder according to the present invention.

FIG. 1 is a plan view of a tamper-resistant display holder for holding a display piece, according to the present invention. Display holder 10 includes a plurality of frame sections 12 which are interconnected with one another at corners 14 in a known manner, such as with mitered corners or with corner pieces (not shown). Each frame section 12 includes a front member 16 which can be pivoted outwardly to open the frame section and facilitate insertion or removal of a display piece 18.

Each frame section 12 includes a magnetically attachable locking tab 20 (shown in phantom) positioned somewhere along the frame section behind front member 16. As described in greater detail below, the locking tab 20 is biased within frame section 12 to prevent front member 16 from being opened or tampered with in the absence of an external magnetic field. To open the frame section, the user slides a magnet 22 along the front member 16 until an attraction is felt between magnet 22 and locking tab 20. Magnet 22 releases locking tab 20 and allows front member 16 of the frame section to be opened. Locking tab 20 is not visible from the exterior display holder 10 and therefore provides an effective and simple locking mechanism for display holder 10. Thus, the user can insert a poster or other advertising material into display holder 10 without fear that the material will be tampered with.

Figure 2:
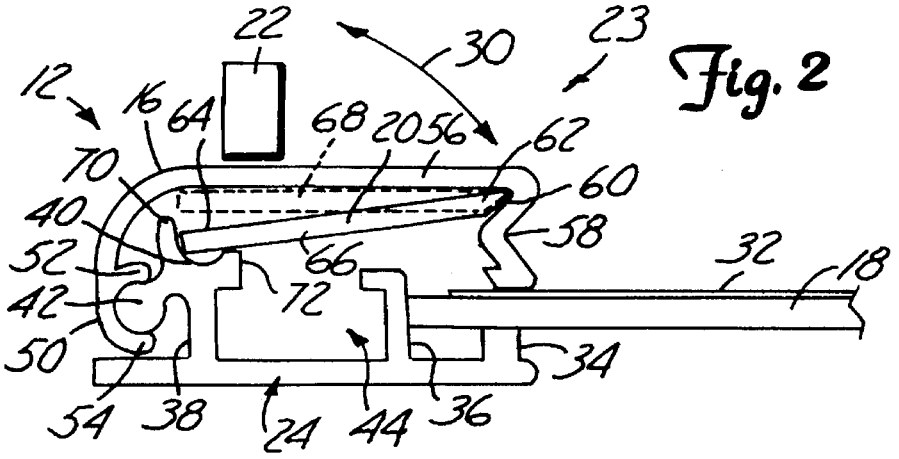
FIG. 2 is a cross section of the display holder taken along lines 2—2 of FIG. 1, which shows a front member of the display holder in a closed position.

FIG. 2 is a cross section of frame section 12 taken along lines 2—2 of FIG. 1. Frame section 12 includes front member 16, locking tab 20 and back member 24. Front member 16 and back member 24 are preferably extruded pieces that are interconnected to one another in a pivotal relationship such that front member 16 is movable between a closed position 23 (FIG. 2) and an opened position 25 (FIG. 3) along arrow 30. In this manner, front member 16 can be opened relative to back member 24 to facilitate insertion or removal of display piece 18. Display piece 18 can also be provided with a protective cover 32, such as a sheet of plexiglass.

Back member 24, includes a stand-off 34 and a flange 36 for positioning display piece 18 within display holder 10. Back portion 24 also includes a flange 38 which forms a channel 44 with flange 36 that may be used to receive corner pieces 14, shown in FIG. 1. Corner pieces 14 include projections (not shown) which are inserted into channel 44.

Flange 38 supports an elongated groove 40 and an elongated hinge 42. Hinge 42 is preferably cylindrical and extends along the length of frame section 12. Front member 16 includes an associated elongated socket 50 which mates with hinge 42 and extends along the length of frame section 12. Socket 50 has an inner diameter which is substantially the same as the outer diameter of hinge 42. Socket 50 includes elements 52 and 54 which preferably extend at least 180 degrees around the circumference of hinge 42 to prevent front member 16 from separating from back member 24. Frame section 12 is assembled by sliding front member 16 onto back member 24 in the longitudinal direction.

Figure 3:
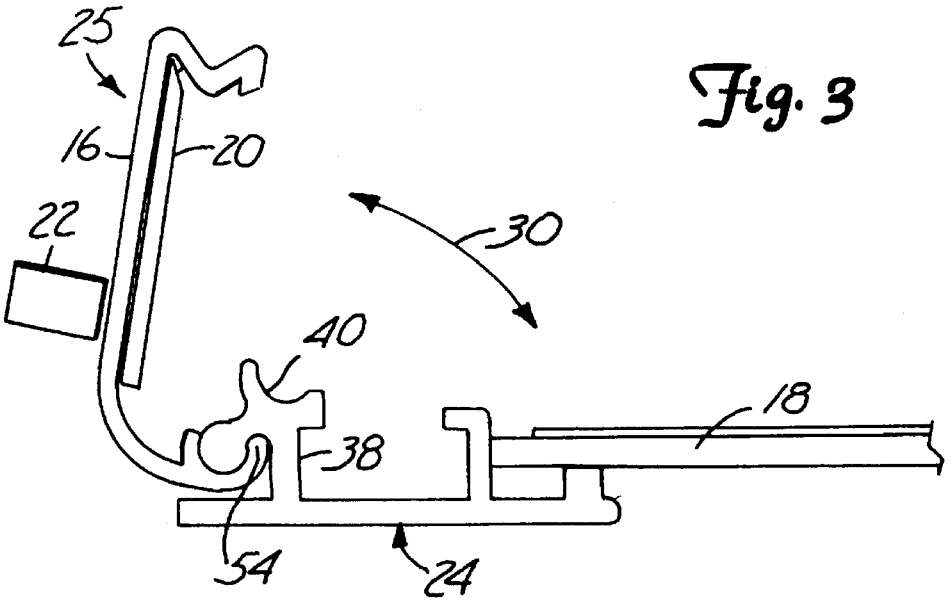
FIG. 3 is a cross section of the display holder similar to FIG. 2, but with the front member in an opened position.

Socket element 54 also provides a stop to limit the outward swing of front member 16 relative to back member 24. As shown in FIG. 3, socket element 54 abuts flange 38 when front member 16 is in the opened position 25, at its maximum outward swing.

Referring back to FIG. 2, front member 16 further includes a face portion 56 and a lip 58. Face portion 56 provides an attractive outward appearance while lip 58 allows the user to easily grasp the front member 16 to move the front member between closed position 23 and opened position 25.

Front member 16 further includes an internal groove 60 for receiving a first end 62 of locking tab 20. First end 62 is pivotally attached in groove 60 such that a second end 64 of tab 20 is movable relative to back member 24 between a locked position 66 and an unlocked position 68 (shown in phantom). In locked position 66, second end 64 of locking tab 20 engages back member 24 within groove 40. In unlocked position 68, second end 64 is disengaged from groove 40 in back member 24.

Groove 40 includes lip portions 70 and 72. Lip portions 70 and 72 extend outwardly, generally away from back member 24. Lip portion 70 extends a greater distance than does lip portion 72 to allow the second end 64 of locking tab 20 to sit within groove 40. Lip portion 70 is preferably "open" such that lip portion 70 does not enclose second end 64 of locking tab 20. Second end 64 is therefore freely movable between locked position 66 and unlocked position 68. Groove 40 can have a semicircular shape, a rectangular shape or any other suitable shape that allows the second end 64 of locking tab 20 to engage and disengage back member 24.

When the second end 64 of locking tab 20 engages back member 24, any attempt to open front member 16 forces second end 64 of tab 20 into lip portion 70, thereby locking front member 16 in closed position 23. When magnet 22 is positioned adjacent locking tab 20, magnet 22 applies an external magnetic field to locking tab 20 which attracts the locking tab and lifts second end 64 of the tab out of locked position 66 and into unlocked position 68. In unlocked position 68, locking tab 20 clears lip portion 70 and thereby allows front member 16 to be moved from closed position 23 to opened position 25 (as shown in FIG. 3).

Figure 4:
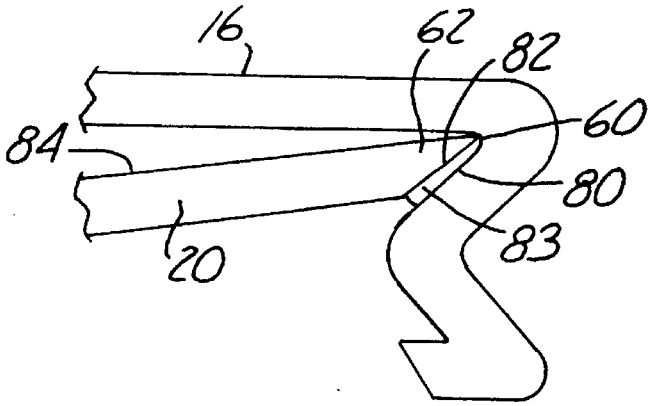
FIG. 4 is an enlarged sectional view of the front member shown in FIGS. 2 and 3.

FIG. 4 is an enlarged section view of front member 16, which shows the attachment between the first end 62 of locking tab 20 and groove 60. As mentioned above, the first end 62 of tab 20 is pivotally attached within groove 60. In a preferred embodiment, the first end 62 and groove 60 have cross sections that mate with one another. In the embodiment shown in FIGS. 2–4, groove 60 includes an angled inner surface 80 which faces generally away from back member 24. The first end 62 of locking tab 20 includes an associated beveled surface 82 which mates with the angled inner surface 80 of groove 60 and generally faces back member 24. First end 62 and groove 60 can have other cross-section configurations, such as curved, rectangular or irregular. However, the beveled or angled surfaces are preferred since they are easy to manufacture and assemble.

First end 62 is attached within groove 60 by an adhesive 83. Adhesive 83 is preferably selected to form a permanent, resilient bond between locking tab 20 and groove 60, which allows the second end 64 of tab 20 to move between the locked and unlocked positions 66 and 68 (shown in FIG. 2). For example, an aircraft grade adhesive is suitable for use with the present invention.

In the embodiment shown in FIG. 4, adhesive 83 is applied between beveled surface 82 of locking tab 20 and angled surface 80 of groove 60. In addition, adhesive can also be applied to other areas of first end 62, such as surface 84, to improve the bond between groove 60 and first end 62 of locking tab 20. Other resilient connections can also be used with the present invention. For example, adhesive 83 can be formed of a plastic strip with an adhesive applied to each surface of the strip.

The first end 62 is preferably bonded within groove 60 such that the second end 64 of tab 20 is biased into groove 40 (FIG. 2) in the absence of the external magnetic field. This prevents locking tab 20 from becoming dislodged from groove 40 with various orientations of frame section 12.

When magnet 22 is positioned adjacent locking tab 20, the magnetic field applied by magnet 22 attracts locking tab 20 and lifts the tab out of locked position 66. When magnet 22 is removed, locking tab 20 returns to locked position 66.

Figure 5A:
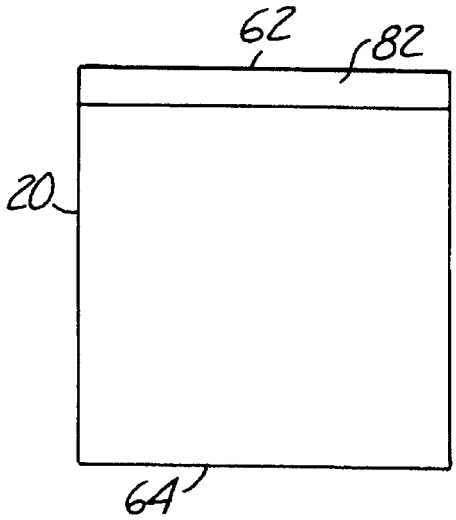
FIG. 5A is a bottom plan view of a locking tab, in accordance with the present invention.

FIG. 5A is a bottom plan view of locking tab 20. Locking tab 20 is a substantially planar strip of metal with first and second ends 62 and 64, respectively. First end 62 includes beveled surface 82. Although locking tab 20 is preferably planar, locking tab 20 can have curves or bends, provided that the locking tab is movable between the locked and the unlocked positions 66 and 68 shown in FIG. 2 and is rigid enough to prevent front member 16 from being opened when the locking tab is in the locked position. Locking tab 20 can be formed of any rigid, magnetically attractable material.

Figure 5B:
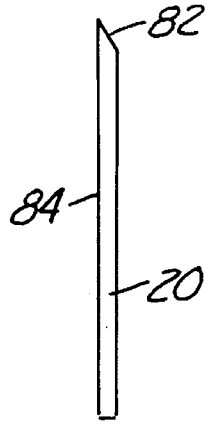
FIG. 5B is a side plan view of the locking tab shown in FIG. 5A.

FIG. 5B is a side plan view of locking tab 20. FIG. 5B shows beveled surface 82 in more detail. In one embodiment, beveled surface 82 forms an angle with surface 84 that is approximately 32 degrees.

Figure 6:
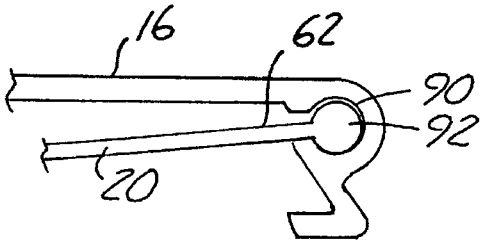
FIG. 6 is a cross section of an alternative hinge assembly in accordance with the present invention.

FIG. 6 illustrates an alternative pivotal attachment between locking tab 20 and front member 16. The same reference numerals are used in FIG. 6 for similar elements as were used with reference to FIG. 1–5. Front member 16 includes an extruded socket 90 which mates with a hinge 92 on the first end 62 of locking tab 20. Hinge 92 can be attached to or integral with first end 62. Hinge 92 is slidably assembled within socket 90. Socket 90 and hinge 92 provide the pivotal relationship between locking tab 20 and front member 16. However, the adhesive connection shown in FIGS. 2–4 is preferred since it is much easier to manufacture and assemble, and since the adhesive inherently biases locking tab 20 into the locked position. However, it should be understood that other methods and arrangements can be used to attach locking tab 20 to front member 16.

Figure 7:
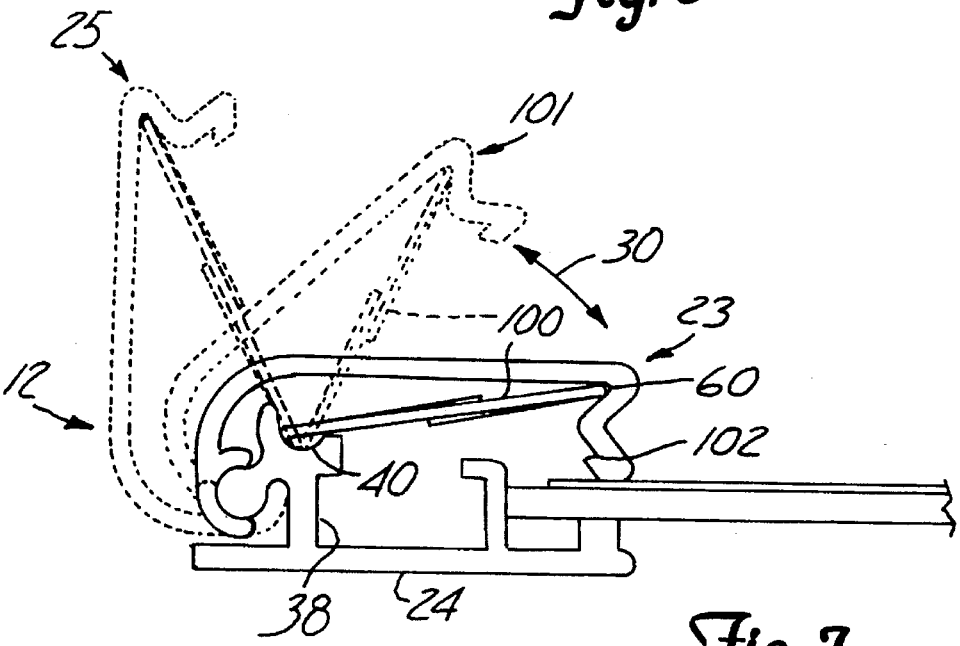
FIG. 7 is cross section of the display holder taken along lines 7—7 of FIG. 1, which illustrates a bias spring within the display holder.

FIG. 7 is a cross section of frame section 12 taken along line 7—7 of FIG. 1. Each frame section 12 includes a bias spring 100 which biases front member 16 in closed position 23 or in open position 25 relative to back member 24. Spring 100 includes a wire loop (shown in FIG. 8) that is compressible in radius. The radius of spring 100 compresses as front member 16 is opened from closed position 23. Maximum compression occurs when front member 16 is opened to 45 degrees at position 101. As front member 16 continues to open, compression decreases to the fully opened position 25. Spring 100 therefore creates a "snap-action" which biases front member 16 in either closed position 23 or opened position 25.

In the embodiment shown in FIG. 7, spring 100 extends between groove 60 in front member 16 and groove 40 in back member 24. In this embodiment, groove 40 is preferably smooth and semicircular to allow spring 100 to pivot within the groove as front member 16 is moved between closed position 23 and opened position 25. In this embodiment, spring 100 occupies the same grooves as does locking tab 20, which is shown in FIGS. 1–5. Spring 100 can be placed in other positions, depending on the geometries of front member 16 and back member 24. For example, spring 100 can extend between groove 40 in back member 24 and a separate groove 102 in front member 16. In addition, flange 38 can be provided with an additional groove (which is separate from groove 40) to accommodate spring 100.

Spring 100 includes ends 104 and 106 which are preferably oriented midway between grooves 40 and 60 to prevent either end from gouging or otherwise interfering with grooves 40 and 60. Spring 100 can be formed with a single loop or with multiple loops. Spring 100 can also be formed as an incomplete loop, but preferably has a circumference which extends at least about 210 degrees.

Spring 100 can be formed of any suitable wire, such as plated 0.042 inch diameter music wire. Other wire or plastic can also be used and should be selected to provide the desired loop stiffness.

Figure 8:
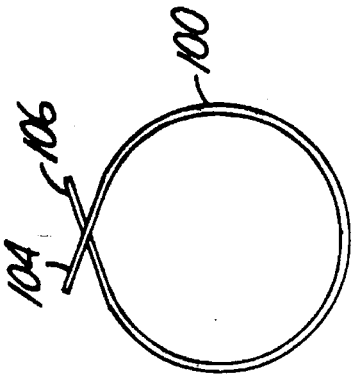
FIG. 8 is a plan view of the bias spring shown in FIG. 6.

Although FIGS. 7 and 8 illustrate the use of a spring formed by a wire loop, any other spring can be used with the locking tab of the present invention. For example, a leaf spring formed of spring steel could also be used with the present invention. The leaf spring would extend between groove 40 in back member 24 and either of grooves 60 or groove 102 in front member 16. The leaf spring would bias the front member 16 through a bending force, as opposed to the compression force exerted by spring 100. An example of a suitable leaf spring is disclosed in U.S. Pat. No. 3,310,901.

Figure 9:
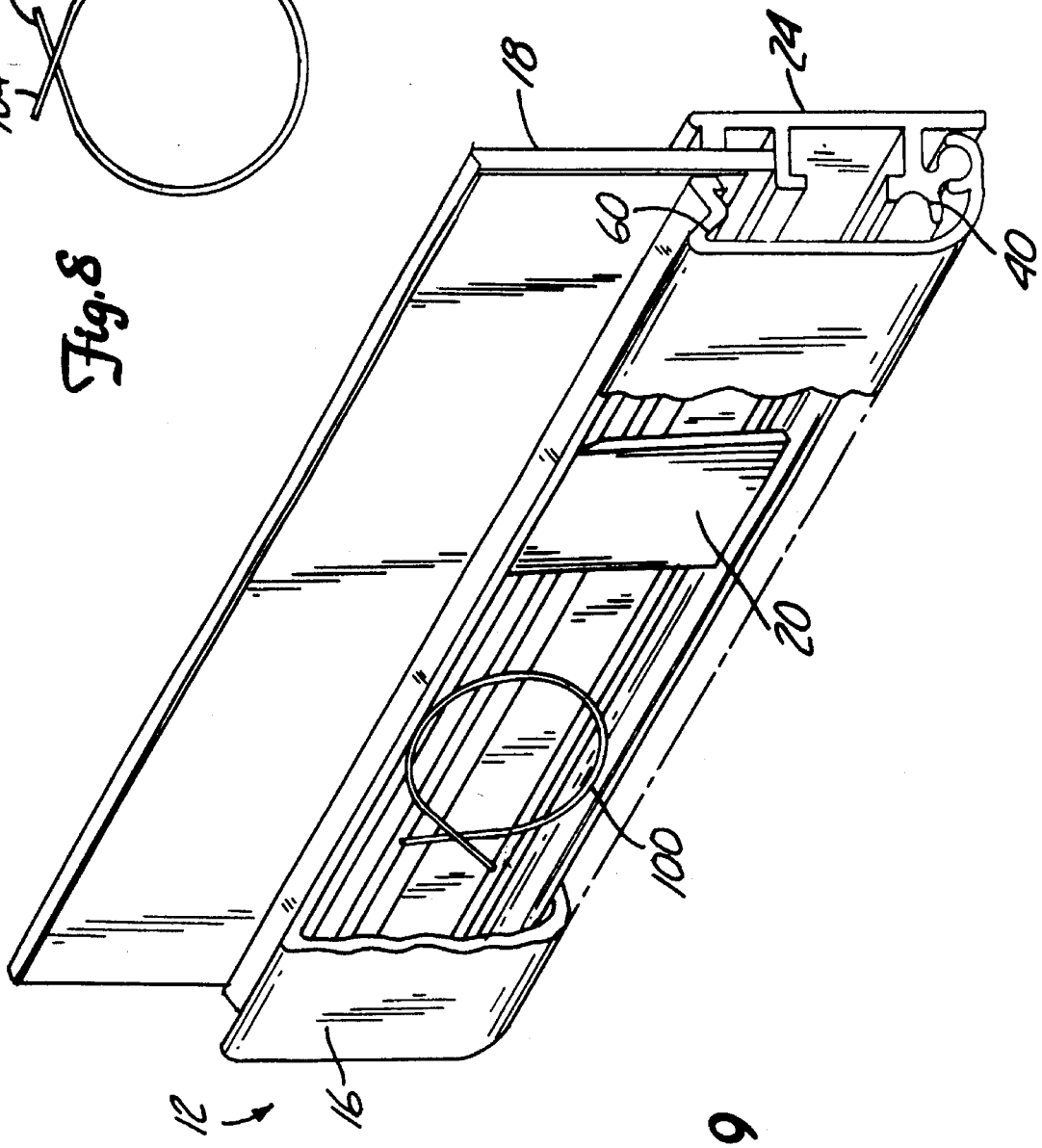
FIG. 9 is a perspective view of a frame section with portions cut away to show the locking tab and the bias spring, in accordance with the present invention.

FIG. 9 is a perspective view of frame section 12 in the closed position with portions cut away to show locking tab 20 in combination with spring 100. Frame section 12 can include one or more locking tabs 20 and springs 100 along its length.

The locking tab of the present invention is simple, convenient to use and effective in preventing tampering. The locking tab can be incorporated into most spring-loaded display formats since the locking tab can be positioned within the same grooves that are used for the bias spring. The locking tab does not require a special key and can be opened with an ordinary magnet which can be provided with the display holder or can be obtained at any hardware store. Since the locking tab cannot be seen from the outside of the display holder, passersby cannot readily determine how the frame sections are locked in place.

Although the present invention has been described with reference to preferred embodiments, workers skilled in the art will recognize that changes may be made in form and detail without departing from the spirit and scope of the invention.

What is claimed is:

1. A display holder comprising:

at least one frame section having an elongated front member and an elongated back member which are generally parallel to one another and have first and second lateral ends, wherein first ends of the front and back members are interconnected with one another in a pivotal relationship and wherein the front member has a first groove at its second end and the back member has a second groove at its first end, with the first and second grooves generally opposing one another; and a locking tab having first and second opposite ends extending between the first and second grooves, respectively, wherein the first end of the tab is pivotally attached in the first groove such that the second end of the tab is movable relative to the back member between a locked position in which the second end of the tab is engaged in the second groove and an unlocked position in which the second end of the tab is disengaged from the second groove, and wherein the locking tab is formed of a magnetically attractable material.

2. The display holder of claim 1 wherein the locking tab is a rigid, substantially planar metal strip which extends generally parallel to the front member.

3. The display holder of claim 1 and further comprising an adhesive positioned between at least a portion of the first end of the locking tab and the first groove, which forms a resilient, pivotal bond between the locking tab and the front member.

4. The display holder of claim 3 wherein the first end of the locking tab is bonded in the first groove such that the second end of the locking tab is biased into the second groove.

5. The display holder of claim 3 wherein the locking tab has an inner surface which generally faces the back member and wherein the display holder further comprises:

a flexible plastic strip having first and second surfaces with the adhesive applied to each of the first and second surfaces, wherein the flexible plastic strip is positioned at the first end of the locking tab, between the inner surface of the locking tab and the first groove.

6. The display holder of claim 1 wherein:

the first groove includes a longitudinal socket; and the first end of the locking tab includes a hinge formation which mates with the socket to form a pivotal relationship between the locking tab and the socket.

7. The display holder of claim 1 wherein the first groove and the first end of the locking tab have cross sections that mate with one another.

8. The display holder of claim 7 wherein:

the first groove has an angled inner surface that faces generally away from the back member; and the first end of the locking tab has a beveled surface that mates with the angled inner surface of the first groove and generally faces the back member.

9. The display holder of claim 8 and further comprising a resilient adhesive positioned between the beveled surface and the angled inner surface, which forms a pivotal, permanent bond between the locking tab and the front member.

10. The display holder of claim 9 wherein the locking tab is bonded in the first groove such that the second end of the locking tab is biased into the second groove.

11. A tamper-resistant display holder that is responsive to selective application of an external magnetic field, comprising:

at least one elongated frame section having a front member and a back member which have first and second ends and which are adapted to be interconnected to one another at the first ends in a pivotal relationship such that the second end of the front member is movable between an opened position and a closed position relative to the back member; and a tab extending from the second end of the front member toward the first end of the back member and generally parallel to the front member and having a first end and a second end, with the first end of the tab being resiliently attached to the second end of the front member so that the second end of the tab is movable between a locked position and an unlocked position relative to the first end of the back member in response to the external magnetic field, wherein the second end of the tab is engaged with the back member in the locked position and the second end of the tab is disengaged from the back member in the unlocked position.

12. The display holder of claim 11 wherein the tab is a rigid, substantially planar metal strip.

13. The display holder of claim 11 and further comprising an adhesive positioned between at least a portion of the first end of the tab and the front member, which forms a resilient, pivotal bond between the tab and the front member.

14. The display holder of claim 13 wherein the first end of the tab is bonded to the front member such that the second end of the tab is biased against the back member.

15. The display holder of claim 13 and further comprising:

a flexible plastic strip having first and second surfaces with the adhesive applied to each of the first and second surfaces, wherein the flexible plastic strip is positioned between the first end of the tab and the front member.

16. The display holder of claim 11 wherein:

the second end of the front member includes a longitudinal socket; and the first end of the tab includes a hinge formation which mates with the socket to form a pivotal relationship between the tab and the socket.

17. The display holder of claim 11 wherein the second end of the front member has a groove which mates with and is attached to the first end of the tab.

18. The display holder of claim 17 wherein:

the groove has an angled inner surface that faces generally away from the back member; and the first end of the tab has a beveled surface that mates with the angled inner surface of the groove and generally faces the back member.

19. The display holder of claim 18 and further comprising a resilient adhesive positioned between the beveled surface and the angled inner surface, which forms a pivotal, permanent bond between the tab and the front member.

20. The display holder of claim 19 wherein:

the back member has a groove which generally opposes the groove in the front member; and the first end of the tab is bonded in the groove in the front member such that the second end of the tab is biased into the groove in the back member.

21. A tamper-resistant display holder that is responsive to selective application of an external magnetic field, comprising:

at least one frame section having an elongated front member and an elongated back member which are adapted to be interconnected to one another in a pivotal relationship, wherein the front member is movable between an opened position and a closed position relative to the back member and wherein the front member is generally parallel to the back member in the closed position; and locking means pivotally extending from and generally parallel to the front member, the locking means having a first end attached to the front member and a second, free end for locking and unlocking the front member relative to the back member, wherein the the second, free end engages the back member in the absence of the external magnetic field and disengages the back member in the presence of the external magnetic field.

22. A tamper-resistant display holder that is responsive to selective application of an external magnetic field, comprising:

at least one elongated frame section having a front member and a back member which are adapted to be interconnected to one another in a pivotal relationship such that the front member is movable between an opened position and a closed position relative to the back member;

a tab extending between the front member and the back member and having a first end and a second end, with the first end being resiliently attached to the front member so that the second end is movable between a locked position and an unlocked position relative to the back member in response to the external magnetic field, wherein the second end is engaged with the back member in the locked position and the second end is disengaged from the back member in the unlocked position; and an adhesive positioned between at least a portion of the first end of the tab and the front member, which forms a resilient, pivotal bond between the tab and the front member.

* * * * *